US005540466A

United States Patent [19]

Duynstee

[11] Patent Number: 5,540,466

[45] Date of Patent: Jul. 30, 1996

[54] MECHANISM FOR LATCHING A ROTARY SHAFT

[75] Inventor: Eduard J. Duynstee, Ouderkerk a/d Ijssel, Netherlands

[73] Assignee: Thyssen de Reus B.V., A/D Ijssel, Netherlands

[21] Appl. No.: 157,144

[22] PCT Filed: Apr. 13, 1993

[86] PCT No.: PCT/NL93/00080

§ 371 Date: Dec. 7, 1993

§ 102(e) Date: Dec. 7, 1993

[87] PCT Pub. No.: WO93/21092

PCT Pub. Date: Oct. 28, 1993

[30] Foreign Application Priority Data

Apr. 13, 1992 [NL] Netherlands ..... 9200683

[51] Int. Cl.[6] ..... E05C 17/32

[52] U.S. Cl. ..... 292/263; 292/DIG. 12; 49/339

[58] Field of Search ..... 292/229, 196, 292/263, DIG. 12, 338, DIG. 17, DIG. 49, DIG. 19, DIG. 25; 49/339, 340, 345; 74/96

[56] References Cited

U.S. PATENT DOCUMENTS

| | | | |
|---|---|---|---|
| 1,721,967 | 7/1929 | Mohr | 292/DIG. 12 |
| 4,202,572 | 5/1980 | Green . | |
| 4,848,175 | 7/1989 | Weiss | 49/345 X |

FOREIGN PATENT DOCUMENTS

| | | | |
|---|---|---|---|
| 0171453 | 2/1986 | European Pat. Off. . | |
| 2591645 | 6/1987 | France . | |
| 644425 | 5/1937 | Germany | 292/196 |
| 1203640 | 10/1965 | Germany | 49/345 |
| 453622 | 6/1968 | Switzerland . | |
| 555705 | 9/1943 | United Kingdom . | |

*Primary Examiner*—Rodney M. Lindsey

*Attorney, Agent, or Firm*—Merchant, Gould, Smith, Edell, Welter & Schmidt, P.A.

[57] ABSTRACT

A mechanism for latching a rotary shaft for, for example, a lift door, provided with a control arm connected to the rotary shaft and pivotally coupled by means of a coupling piece to an operating arm which is rotatable about a fixed shaft, coupling piece and operating arm being brought into line with each other for the latching of a rotary shaft, and a control mechanism being present for operating the latch. The operating arm bears a further shaft, upon which the control mechanism acts, and which can be actuated by a control unit, which can unlatch the mechanism while at the same time tensioning spring means, which on blocking of the rotary shaft are additionally tensioned, which additional tensioning still rotates the rotary shaft further when the blocking is removed, and in which the control unit can release the control mechanism, with the result that the spring means tensioned earlier will rotate the rotary shaft to the latched position.

9 Claims, 3 Drawing Sheets

MECHANISM FOR LATCHING A ROTARY SHAFT

BACKGROUND OF THE INVENTION

The invention relates to a mechanism for latching a rotary shaft, which mechanism is provided with a control arm, which at its one end is immovably connected to the rotary shaft and at its other end is coupled by a pivotal shaft to the end of a coupling piece, the other end of which is connected by means of a pivotal shaft to one end of an operating arm, which is rotatable about a pivotal shaft mounted immovably relative to the rotary shaft, the pivotal shaft between the coupling piece and the operating arm running parallel to both the pivotal shaft between the control arm and the coupling piece and the pivotal shaft mounted immovably relative to the rotary shaft, and being movable both into and out of the plane determined by both last-mentioned pivotal shafts, for latching or rotating the rotary shaft.

Such a mechanism is known from U.S. Pat. No. 4,202,572. In this case the control arm bears the bolt of a lock for an escape door, so that in normal circumstances the mechanism will always be in the latched position. If the escape door has to be used, the mechanism can be operated by a control unit in the form of a push-button, which on displacement acts upon the coupling piece and in so doing unlatches the mechanism, with the result that the bolt releases and the escape door can be pushed open by hand. The escape door will then swing into the open position in quite an uncontrolled manner.

SUMMARY OF THE INVENTION

The object of the invention is to improve such a mechanism in such a way that a controlled opening and closing of a door can be achieved therewith, in such a way that it is suitable for operating a swing lift door, which means that, on the one hand, a reliable latched position must be ensured and, on the other, a blocking of the swing movement of the lift door must not lead to unacceptable forces on the person or object causing the blocking, or on the mechanism itself.

This is achieved according to the invention by a mechanism of the type described in the preamble, in which the operating arm bears a further shaft at a distance from the immovably mounted shaft, upon which shaft an element of the control mechanism acts pivotally, and the control mechanism can be actuated by a control unit which in a first control position exerts a positive force on the control mechanism, which force can rotate the rotary shaft out of its latched position into a second position while at the same time tensioning spring means belonging to the control mechanism, which spring means on blocking of a rotation of the rotary shaft, and thus of the operating arm, are additionally tensioned through absorbing the force exerted by the control unit when the operating arm is at a standstill, which additional tension on removal of the blocking still moves the rotary shaft into the second position, and where in a second control position the control unit essentially releases the control mechanism, with the result that the spring means tensioned earlier can cause the rotary shaft to rotate out of the second position into the latched position.

Through these measures, a suitable actuation of the control unit means that a reliable latched position is automatically obtained through the operating arm and the coupling piece moving into line with each other. Further turning of the control arm is not possible, due to the fact that the operating arm and the control arm are lying in line with each other; turning back is prevented, due to the fact that a force exerted by the control arm exerts only a pressure force, but no moment, on the assembly of operating arm and coupling piece lying in its dead centre position. It goes without saying that said assembly can also lie slightly past the dead centre position.

Moving out of the latched position is effected by a displacement carried out by the control unit, by means of which a force is exerted on the control mechanism, which during normal operation will thus cause the rotary shaft to rotate and will make a lift door fixed thereto swing open, while at the same time energy is stored in the spring means, in order to be able to bring about a swing of the lift door in the opposite direction until it is in the latched position. The presence of said spring means is advantageously used for allowing movement of the control unit to continue unimpeded when the swing of the lift door is blocked. In this case this movement is converted into an additional energy storage in the spring means, so that on removal of the blocking the desired swinging open of the lift door is still effected by said additional stored energy. Pushing shut an open lift door through forces exerted from the outside is possible through the spring means, said pushing shut being absorbed in a damping manner by said spring means, and being undone again after removal of the external forces.

The lift door is closed by removing the controlling force of the control unit on the control mechanism, following which the energy stored in the spring means during opening makes the lift door swing shut. It will be clear that during blocking of said swinging shut only relatively low spring forces are exerted on the blocking person or the blocking object, so that a risk of becoming trapped therein is effectively eliminated, while the mechanism is also extremely vandal-resistant. Once the latched position is reached, the door is reliably secured, as is necessary in the case of a lift, and opening is possible only through operation of the control mechanism.

According to a further embodiment of the invention, it is preferable that in the latched position of the mechanism a plane in which the two axes of the coupling piece are situated also contains the axis of the immovably mounted pivotal shaft of the operating arm, which position is partly determined by a stop against which the coupling piece or the operating arm strikes. This produces a clearly determined latched position, which is maintained in an extremely reliable way partly through the presence of the stop interacting with the spring means.

In order to make the open door vandal-resistant in both directions of rotation when the latching mechanism is in the open position, in which a door has been rotated through, for example, 90° relative to its closed position, according to a further embodiment of the invention it is preferable that in the second position of the mechanism the plane in which the two axes of the coupling piece lie should form an obtuse angle with the plane in which the axes of the rotary shaft and the pivotal shaft between the control arm and the coupling piece lie. The rod system of the latching mechanism then permits a rotation in both directions, which rotation is permitted when forces are exerted from the outside and is absorbed by the spring means.

The control mechanism can be designed in many different ways. Relatively few parts will suffice if, according to a further embodiment of the invention, the control mechanism is provided with a chain wheel fixed in a freely rotatable manner on the further shaft, the rotation of which wheel relative to the operating arm is limited by a stop pin which is fixed on the chain wheel and can come to a stop against the operating arm, around which chain wheel a chain is passed, one end of which is for attaching to the control unit, while the other end is attached to a tension spring, all this being in such a way that in the latched position the stop pin presses the operating arm against the stop, and a movement out of the latched position can be achieved by pulling on the chain by means of the control unit.

Due to the fact that the chain is held fast at one end by a tension spring, when forces coming from the outside are exerted, the mechanism can yield and in so doing absorb said forces in a damping manner, so that forces exerted on an opening or open door cannot damage the displacement and latching mechanism. The door is closed by releasing the earlier tensioned chain. The tension spring actuating the mechanism in this case ensures that the rotary shaft is moved to the closed position.

A construction requiring a few more parts, but which is mechanically and kinematically simpler, can be achieved for the control mechanism if according to a further embodiment of the invention the control mechanism is provided with a control rod, one end of which is pivotally fixed on the further shaft, while the other end is pivotally coupled to one end of a coupling rod, the other end of which is pivotally connected to one end of a sliding rod disposed in such a way that it can be moved in its lengthwise direction, and is pressed by a compression spring acting upon the sliding rod towards a stop face on a swing lever, which is pivotally connected to the coupling rod at a place between the pivotal shafts at the ends of the coupling rod, and is rotatable about a shaft immovably fixed relative to the rotary shaft, all this being in such a way that a movement out of the latched position can be achieved by making the swing lever rotate by means of the control unit.

Starting from the locked position, by swinging the swing lever, effected by the control unit, the coupling rod will be swung relative to its pivot point with the sliding rod, and will thus move the control rod and make the operating arm swing, which results in the lift door swinging open. However, the swinging of the swing lever also results in a movement of the sliding rod and thus tensioning of the compression spring, so that retracting the control unit by releasing the compression spring results in the lift door swinging shut. Swings of the door produced from the outside result in a swinging of the coupling rod about its pivot point with the swing lever, and thus in a resilient movement of the sliding rod.

Active operation of the control mechanism by the control unit is necessary only during the opening and closing movement of the mechanism; the control unit is not necessary for latching and holding in the latched position, since this is effected, inter alia, by the spring means. According to a further embodiment of the invention, use can be made of this in an advantageous way by accommodating the control unit in a movable lift platform. This means that, irrespective of the number of floors (at least two) at which a lift door must be unlatched, opened, closed and latched again, only one control unit, which can be operated electrically, manually or in another way, is needed.

BRIEF DESCRIPTION OF THE DRAWINGS

The operating and latching mechanism according to the invention will now be illustrated and explained in further detail with reference to examples of embodiments shown in the drawing, in which.

DETAILED DESCRIPTION OF THE PREFERRED EMBODIMENT

Figure 1:
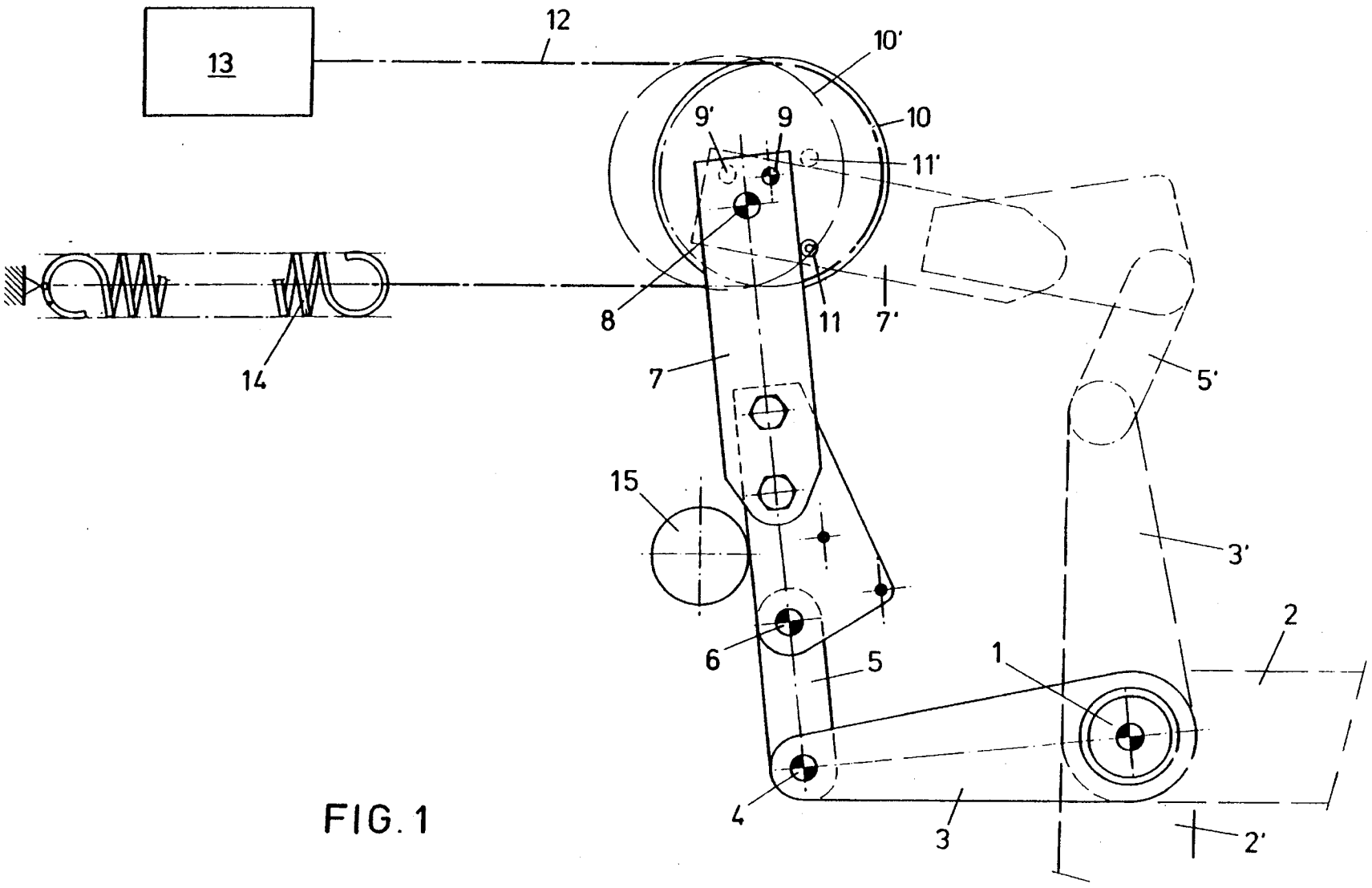
FIG. 1 shows in top view a first embodiment of the mechanism.

The mechanism shown in FIG. 1 is intended for rotating and locking a rotary shaft 1 of a diagrammatically illustrated door which in the position indicated by 2 is closed and latched and in the position indicated by 2' is open.

Fixed on the rotary shaft 1 is a control arm 3, the free end of which is connected by means of a pivotal shaft 4 to a coupling piece 5, the other end of which is connected by means of a pivotal shaft 6 to one end of an operating arm 7, which is composed of two rigidly interconnected parts and at its other end bears a shaft 8 which is immovably mounted relative to the rotary shaft 1. Near its rotary shaft 8 the operating arm 7 bears a further shaft 9, on which a chain wheel 10 is fixed in a freely rotatable manner. The free rotation of the chain wheel 10 about the shaft 9 is limited by a stop pin 11, which is immovably connected to the chain wheel 10 and on rotation of said wheel comes to rest against the operating arm 7. Passed around the chain wheel 10 is a chain 12, one end of which is connected to a control unit 13, while the other end is connected to a tension spring 14.

The latched position is shown by solid lines in FIG. 1. This position is obtained through the fact that the coupling piece 5 and the operating arm 7 are brought into line with each other. The position is achieved by releasing the control unit, as a result of which the tension spring 14 by means of the chain 12 and the stop pin 11 has caused the shaft 9 of the chain wheel 10 to rotate about the shaft 8 and in so doing swung the operating arm 7 to the right, in which case said arm 7 has come to rest against a stop 15, in which stop position the coupling piece lies in line with the operating arm 7.

The door 2 in the closed position is then latched. An attempt to make the door 2 swing further to the left results only in a pulling force in the parts 5 and 7 lying in line with each other. An attempt to press the door 2 to the right into the open position results in a pressure force in the parts 5 and 7. Said parts are prevented from giving way by the stop 15, and it should also be pointed out that the parts 5 and 7 are pre-loaded by the tension spring 14 in the direction of the stop 15. An in fact independent, energised latched position is thus obtained.

For taking the mechanism out of the latched position, the control unit 13 is actuated, so that it pulls on the chain 12. This results in an increase in the tension in the tension spring 14, a rotation of the chain wheel 10 about the shaft 9, and a rotation of the shaft 9 and the operating arm 7 connected thereto about the shaft 8. The operating arm 7 is released from the stop 15 and during pivoting about the shafts 6, 4 and 1 carries along the coupling piece 5 and the control arm 3, with the result that the door 2 is opened. The positions assumed by the various parts when the door is open are indicated by 2', 3', 5', 7', 10' and 11'.

If the door is blocked during its opening movement, the parts 3, 5 and 7, and thus also the shaft 9, will not be able to move. However, this has no adverse effect on the control unit 13. The latter remains pulling on the chain 12 in the same way, which then results in only rotation of the chain wheel 10 about the shaft 9 and extension of the spring 14.

The door is held in the open position by blocking movement of the chain 12 relative to the control unit 13. If in that position of the door a swinging force is exerted thereon, this has no harmful consequences either for the door or for the mechanism, as will be explained further below.

If a force is exerted on the open door 2' in the direction of the closed position, the door will yield resiliently in that direction, which is made possible by the mechanism as follows.

Swinging of the control arm 3' to the left is possible only if the operating arm 7' can rotate to the right, which involves a clockwise movement of the shaft 9' about the shaft 8, and therefore a movement of the chain wheel 10' to the right. The chain 12 is held fast in the control unit 13. The movement of the chain wheel is, however, made possible by a further extension of the spring 14, with the result that the chain wheel 10' can roll along the chain in order to permit a swing of the door 2' initiated from the outside. It will also be clear that when the force exerted on the door from the outside stops, the additionally extended spring 14 will draw the door back into its open position indicated by 2'.

If a force is exerted on the door 2' for the purpose of trying to swing the door further out of its closed position, this movement will also be possible through the door yielding resiliently. The door can be swung further, because the control arm 3' and the coupling piece 5' form an obtuse angle with each other. In order to be able to make the control arm turn further to the right, the operating arm 7' must be able to turn further to the left. This rotation is made possible by the tension spring 14. When the operating arm 7' is swung to the left, by means of the stop pin 11' it will make the chain wheel 10' rotate in the same direction, in which case the tension spring 14 is tensioned further and the chain will sag slightly between the chain wheel 10' and the control unit 13. When said force coming from the outside onto the door stops, the door will draw back again into the position shown by 2' as a result of spring 14.

When the door is being moved from the open into the closed position, it must be ensured that nothing or nobody can become trapped as a result of the closing door. In the case of the present mechanism this is achieved through the fact that the closing of the door is brought about by compressing the spring 14, so that the closing force can never be greater than the force to be supplied by the tension spring 14. A reliable anti-trapping safety device is provided in this way.

The above-described mechanism is directly coupled to the rotary shaft of a door, and in the case of lift doors must therefore be present on every floor. Here the mechanism can be built into a door sill. In that case the door 2 in its closed position will generally point left in the figure, and the door will swing over the mechanism to its open position 2', in which the door will then point upwards in the figure. It will be clear that if the door is fixed facing differently on the rotary shaft, this does not affect the functioning of the mechanism as described above.

As should appear from the above description, the mechanism is energised by the tension spring 14. The control unit 13 is necessary only for opening the door and keeping it open. The control unit has no direct function in the latching of the door. This then means that the control unit can be built into the lift platform and on arrival at a floor where the door must be opened, after coupling to the latching and opening mechanism built in there, can do its work, in other words, pull on the chain. Just one control unit is therefore required for all doors disposed on different floors.

Lift door constructions in which two opening lift doors are present at each floor are generally known. In such a case both doors must be provided with a latching and opening mechanism on each floor. If in that case a disconnectable control unit is used, then it must operate both mechanisms, or must be made double.

Figure 2:
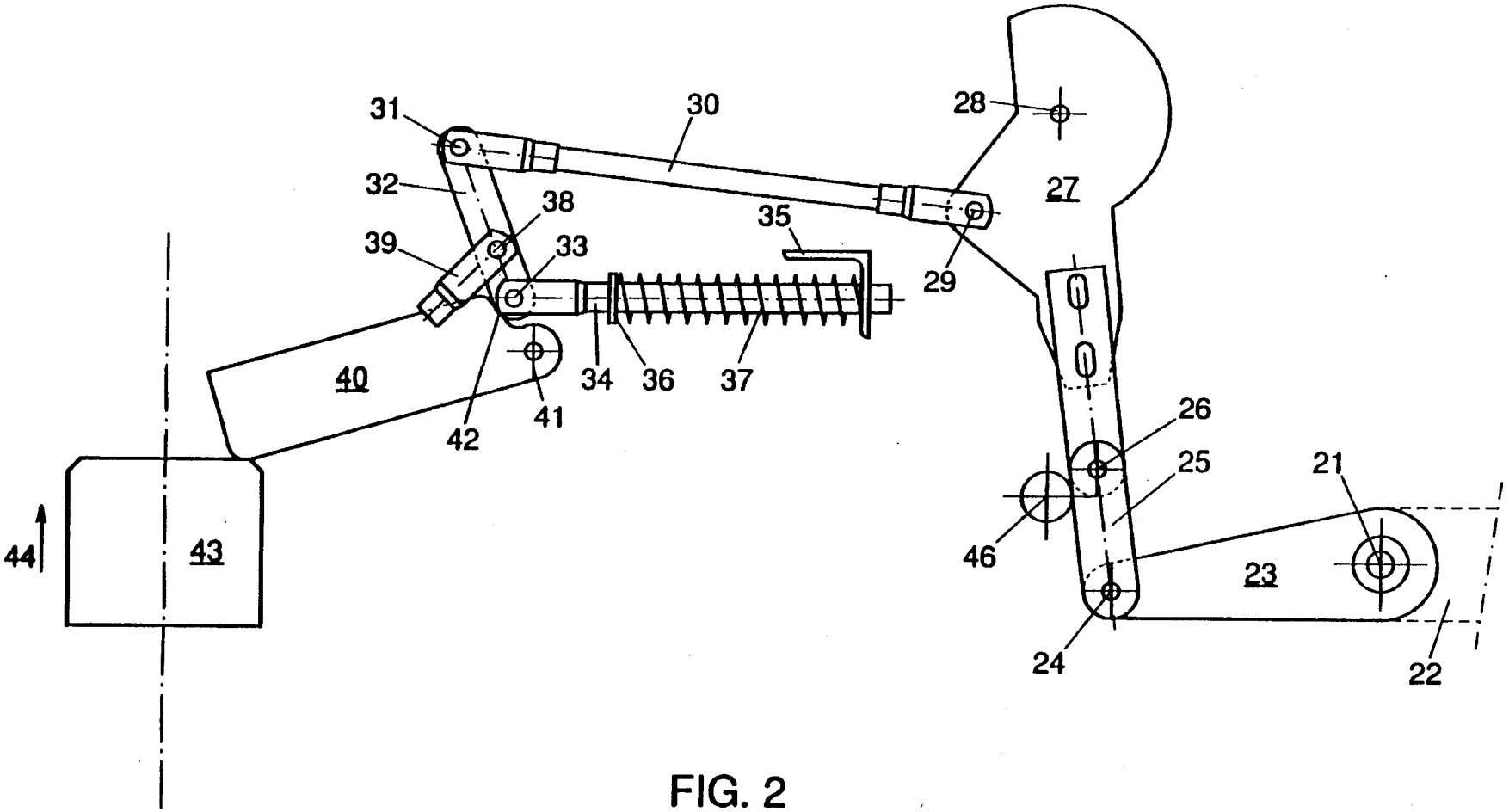
FIG. 2 shows in top view a second embodiment of the mechanism in the latched position.
Figure 3:
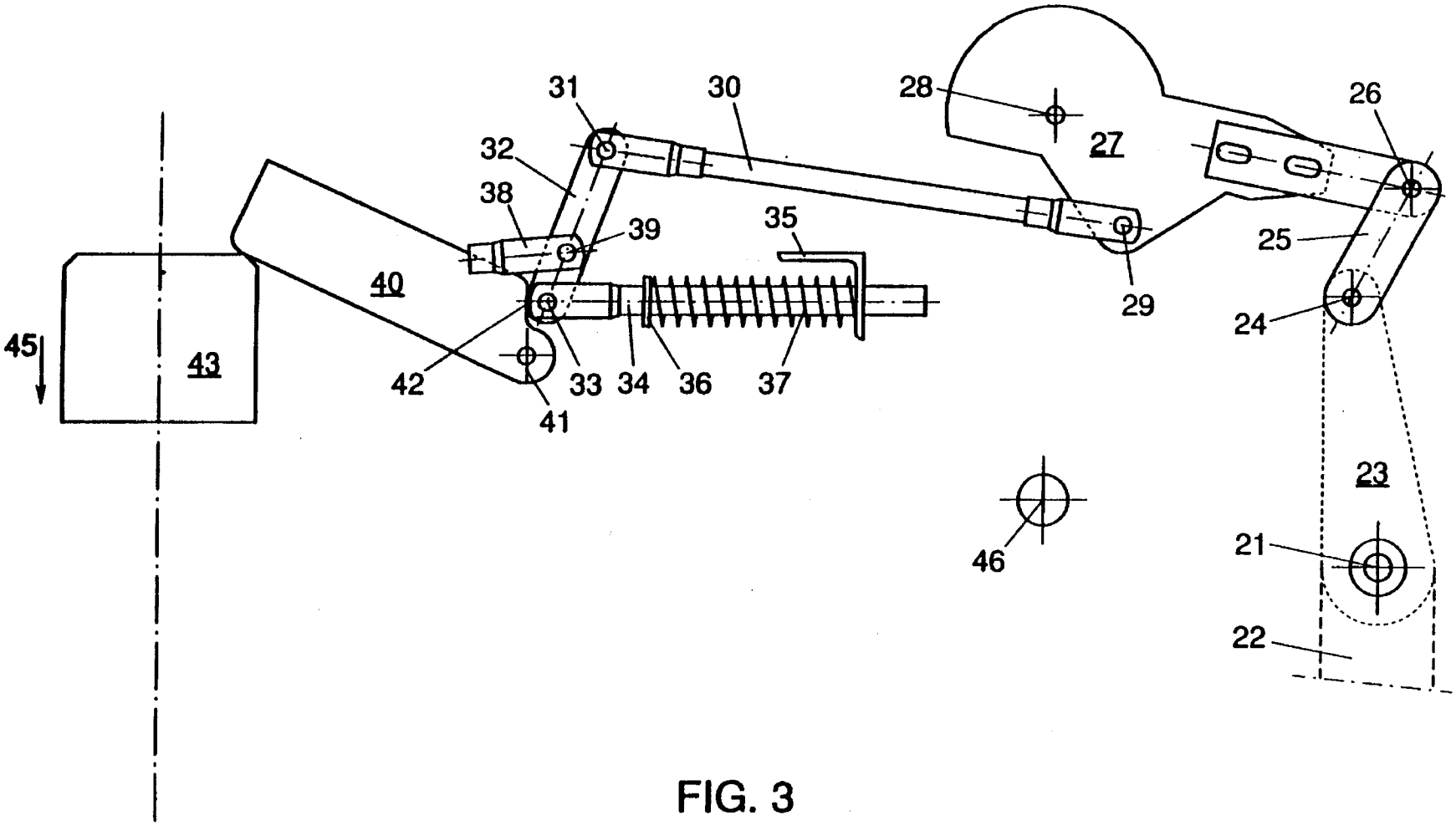
FIG. 3 shows the mechanism according to FIG. 2 in the second position.

The mechanism shown in FIGS. 2 and 3 is provided with a rotary shaft 21 for a lift door 22, on which rotary shaft a control arm 23 is fixed, the free end of which is connected by means of a pivotal shaft 24 to a coupling piece 25, the other end of which is connected by means of a pivotal shaft 26 to one end of an operating arm 27, which is composed of two rigidly interconnected parts and at its other end bears a shaft 28 which is immovably mounted relative to the rotary shaft 21. Near its rotary shaft 28, the operating arm 27 bears a further shaft 29, upon which the end of a control rod 30 acts pivotally, the other end of which rod is connected by means of a pivotal shaft 31 to one end of a coupling rod 32, the other end of which in turn is pivotally connected by means of a shaft 33 to one end of a sliding rod 34, which is accommodated so that it can slide in its lengthwise direction in a guide 35, which is immovably fixed relative to the shafts 21 and 28. The sliding rod 34 is provided with a collar 36, and a compression spring 37 is confined between the guide 35 and the collar 36. The coupling rod 32 is provided with a pivot 38 between the pivotal shafts 31 and 33, on which pivot 38 a bifurcated part 39 is rotatably mounted. The bifurcated part 39 is immovably connected to a swing lever 40, which is rotatable about a shaft 41 which is immovably fixed relative to the shafts 21 and 28. The swing lever 40 is also provided with a cam surface 42, against which, through the action of the spring 37, the pivoting ends of the coupling rod 32 and the sliding rod 34 connected by the shaft 33 are pushed, with the result that the swing lever 40 is pushed to the left, so that its free end is in contact with a control unit 43, which can be moved in a controlled manner in the direction of arrow 44.

Starting from the latched position shown in FIG. 2, the mechanism works as follows.

By moving the control unit 43 in the direction of arrow 44, the swing lever 40 is rotated to the right in the direction of arrow 44, with the result that the cam surface 42 slides the sliding rod 34 to the right while compressing the spring 37, and the bifurcated part 39 makes the coupling rod 32 rotate to the right about the pivotal shaft 33. This movement and rotation result in the pivotal shaft 31, and thus the control rod 30, sliding to the right, which in turn results in a swing to the left of the operating arm 27. Said swing of the operating arm 27 means leaving the latched position, and the control arm 23, which is connected to the operating arm 27 by means of the coupling piece 25, will rotate to the right, as a result of which the lift door 22 swings from its closed to its open position.

If this swinging open of the lift door 22 is blocked, this means that the operating arm 27 cannot rotate further. Continued movement of the control unit 43 then results in a further rotation of the swing lever 40. Through the blocking of the operating arm 27, the pivotal shaft 31 will be held virtually in place, as a result of which the bifurcated part 39 makes the coupling rod 32 rotate about the axis 31, which results in an additional movement of the sliding rod 34, which becomes visible through the sliding rod 34 then coming away from the cam surface 42. In this way additional energy is stored in the compression spring 37, which ensures as soon as the blocking is removed that by pushing the sliding rod 34 until it is in contact again with the cam surface 42 the rotation of the rotary shaft 21 intended by the movement of the control unit 43 is still achieved, as a result of which the lift door 22 moves, for example, into the open position shown in FIG. 3.

If in this open position the lift door 22 is pushed by hand in the direction of its closed position, then this movement is permitted as follows and is resiliently absorbed by the mechanism. Pushing towards the closed position makes the operating arm 27 turn to the right, which is possible by tilting the coupling rod 32 about the pivot 38 and moving the sliding rod 34 to the right. The latter results in a compression of the compression spring 37. When the pushing into the closed position is ended, the compression spring 37 will expand again and in so doing move the lift door 22 back into its earlier open position.

Pushing the lift door 22 further open from the open position shown in FIG. 3 causes the operating arm to swing further to the left, which further swing is possible through the fact that the control rod 30 makes the swing lever 40 rotate further to the right by means of the coupling rod 32 and the bifurcated part 39. This rotation also results in a movement of the cam surface 42, and thus a compression of the compression spring 37, so that after removal of the pushing force the lift door 22 will now again be pressed back to the position shown in FIG. 3.

For closing and locking the lift door 22, the control unit is moved in the direction of the arrow 45, with the result that the swing lever 40 is more or less released. The compression spring 37 will then expand and cause the swing lever 40 to rotate to the left, as a result of which the pivotal shaft 31, and thus the control rod 30, are pulled to the left by means of the bifurcated part 39 and the coupling rod 32. This now results in a swing to the right of the operating arm 27, so that it strikes against a stop 46, with the result that the latched position shown in FIG. 2 is obtained again.

If the swing of the lift door 22 is blocked during the movement from the open to the closed position, for example through a person or an object coming into contact with the lift door, then the force with which the lift door 22 pushes against said person or object is relatively small, because said force is produced by the expanding compression spring 37. The chance of anyone or anything becoming trapped is therefore negligible. It will also be clear that removal of the blocking causes the lift door 22 to be swung by the compression spring 37 further into its closed, latched position.

It goes without saying that many modifications and variants are possible within the scope of the invention as set out in the claims which follow. For example, the operating arm shown is composed of two parts. This provides an adjusting facility for the mechanism. Of course, adjustment is also possible by fitting such a facility on or at the stop. Provisions will also have to be made for detection of the mechanism reaching the latched position, following which the motor for moving the lift can be put into operation.

We claim:

1. A mechanism for latching a rotary shaft, the mechanism comprising:

a control arm, which at its one end is immovably connected to the rotary shaft and at its other end is coupled by a first pivotal shaft to one end of a coupling piece, the other end of the coupling piece is connected by means of a second pivotal shaft to one end of an operating arm, which is rotatable about a third pivotal shaft mounted immovably relative to the rotary shaft, the second pivotal shaft between the coupling piece and the operating arm running parallel to both the first pivotal shaft between the control arm and the coupling piece and the third pivotal shaft mounted immovably relative to the rotary shaft, and being movable both into and out of a plane defined by both the first and third pivotal shafts, for latching or rotating the rotary shaft;

wherein the operating arm bears a further shaft at a distance from the third pivotal shaft, an element of a control mechanism acts pivotally upon the further shaft; and a control unit for actuating the control mechanism, wherein the control unit in a first control position exerts a positive force on the control mechanism, the positive force rotates the rotary shaft out of a latched position into a second position while at a same time tensioning a spring means of the control mechanism;

wherein the spring means on blocking of a rotation of the rotary shaft, and thus of the operating arm, is additionally tensioned through absorbing the positive force exerted by the control unit when the operating arm is at a standstill, which additional tension on removal of the blocking still moves the rotary shaft into the second position, and where in a second control position the control unit essentially releases the control mechanism, with a result that the spring means tensioned earlier causes the rotary shaft to rotate out of the second position into the latched position.

2. A mechanism according to claim 1, wherein in the latched position of the rotary shaft a plane in which two axes of the coupling piece are situated also contains an axis of the third pivotal shaft of the operating arm, which position is partly determined by a stop against which the coupling piece or the operating arm strikes.

3. A mechanism according to claim 1, wherein in the second position of the rotary shaft a plane in which two axes of the coupling piece lie forms an obtuse angle with a plane in which axes of the rotary shaft and the first pivotal shaft between the control arm and the coupling piece lie.

4. A mechanism according to claim 3, wherein the control mechanism is provided with a chain wheel fixed in a freely rotatable manner on the further shaft, rotation of the chain wheel relative to the operating arm is limited by a stop pin which is fixed on the chain wheel and comes to a stop against the operating arm, around which chain wheel a chain is passed, one end of the chain is attached to the control unit, while the other end of the chain is attached to a tension spring, the control mechanism being in such a way that in the latched position of the rotary shaft the stop pin presses the operating arm against the stop, and a movement out of the latched position is achieved by pulling on the chain by means of the control unit.

5. A mechanism according to claim 4, wherein the control unit is accommodated in a movable lift platform and is detachably connected to the chain.

6. A mechanism according to claim 3, wherein the control mechanism is provided with a control rod, one end of the control rod is pivotally fixed on the further shaft, while the other end of the control rod is pivotally coupled to one end of a coupling rod, the other end of the coupling rod is pivotally connected to one end of a sliding rod disposed in such a way that the sliding rod is moved in a lengthwise direction, and is pressed by a compression spring acting upon the sliding rod towards a stop face on a swing lever, which is pivotally connected to the coupling rod at a place between pivotal shafts at the ends of the coupling rod, and is rotatable about a shaft immovably fixed relative to the rotary shaft, such that a movement out of the latched position is achieved by making the swing lever rotate by means of the control unit.

7. A mechanism according to claim 6, wherein a pivotal connection between the coupling rod and the sliding rod lies between the shaft of the swing lever immovably fixed relative to the rotary shaft and a pivotal connection between the swing lever and the coupling rod.

8. A mechanism according to claim 7, wherein during an unimpeded movement from the latched position to the second position and vice versa an axis of the pivotal connection between the coupling rod and the sliding rod lies essentially in a plane determined by an axis of the shaft immovably fixed relative to the rotary shaft and an axis of the pivotal connection between the swing lever and the coupling rod.

9. A mechanism according to claim 8, wherein the control unit is accommodated in a movable lift platform.

* * * * *